US007429038B2

(12) United States Patent
Ruthenberg et al.

(10) Patent No.: US 7,429,038 B2
(45) Date of Patent: Sep. 30, 2008

(54) FINISHER FOR IMAGE FORMING APPARATUS

(75) Inventors: Raymond Matthew Ruthenberg, Toronto (CA); Joseph Andre Michel Loiselle, Brampton (CA); Robert Hugh Brown, Ancaster (CA)

(73) Assignee: Xerox Corporation, Norwalk, CT (US)

( * ) Notice: Subject to any disclaimer, the term of this patent is extended or adjusted under 35 U.S.C. 154(b) by 203 days.

(21) Appl. No.: 11/457,925

(22) Filed: Jul. 17, 2006

(65) Prior Publication Data

US 2008/0012196 A1 Jan. 17, 2008

(51) Int. Cl.
*B65H 37/04* (2006.01)

(52) U.S. Cl. ..... 270/59; 270/58.07; 270/58.08; 270/58.09; 271/182; 271/188; 271/209

(58) Field of Classification Search ..... 270/59, 270/58.02, 58.07, 58.08, 58.09; 271/182, 271/188, 202, 209; 83/86, 110, 156, 167, 83/176, 262, 269, 370, 371, 372, 560
See application file for complete search history.

(56) References Cited

U.S. PATENT DOCUMENTS 5,509,645 A * 4/1996 Shinno et al. ..... 270/58.17
5,689,795 A * 11/1997 Mastrandrea ..... 399/407
6,014,920 A * 1/2000 Yamauchi et al. ..... 83/560
6,361,036 B1 * 3/2002 Nakazawa ..... 270/58.07
6,805,347 B2 * 10/2004 Kuramoto ..... 271/242

* cited by examiner

*Primary Examiner*—Gene O. Crawford
*Assistant Examiner*—Leslie Nicholson, III
(74) *Attorney, Agent, or Firm*—Oliff & Berridge PLC

(57) ABSTRACT

A finisher for an image forming apparatus includes a pair of rotatable downstream rollers and a pair of rotatable upstream roller between which a path on which an imaged medium travels. The finisher determines when a trailing edge of the medium is about to leave a nip of the upstream rollers and then stops a leading edge of the medium. By stopping the leading edge of the medium, the medium buckles and the trailing edge registers against the upstream nip line. A finishing device performs a hole punch, staple, or other finishing operation to the medium when the trailing edge registers against the upstream nip line. The finishing operation is performed at a speed equal to or greater than a speed at which the image forming apparatus forms the image on the medium and outputs the medium to the finisher.

20 Claims, 5 Drawing Sheets

FINISHER FOR IMAGE FORMING APPARATUS

BACKGROUND

The exemplary embodiments relate to a finisher for an image forming apparatus such as a copier, a printer, or a facsimile machine. The finisher may perform any number of operations, such as, predetermined punching, stapling, etcetera, for each medium, such as a sheet, on which an image is formed by the image forming apparatus.

The related art includes a number of finishing operations. For example, in the related art, a finisher for performing punching includes a punch mechanism (puncher), which moves to a predetermined position based on size information of a medium, such as a sheet of paper (or other medium to be punched). For example, the puncher is positioned at a particular location along a sheet of paper based on the width of the paper. A plurality of detectors are placed corresponding to a plurality of sheet sizes, and a puncher is moved into position based on the detection information for performing punching on a specific sheet. This related art finisher requires a plurality of detectors, which increases the cost of the apparatus. In addition, from a design standpoint, it may be problematic to provide sufficient detectors to cover a number of sheets having similar sizes, due to, for example, space constraints. Furthermore, determining where to place each of the plurality of detectors to preferably correspond to the plurality of different sheet sizes becomes problematic.

Another related art finisher only utilizes one detector. This sole detector detects the width of a sheet (or other medium), and the position at which a puncher is moved is determined in response to the detected width of the sheet. Punching is performed under the condition determined for each sheet. However, use of the sole detector necessitates that the puncher be reset for each sheet to match the size of the sheet. Resetting the puncher for each sheet takes time, and thus may reduce productivity of high-speed imaging forming apparatuses.

SUMMARY

The exemplary embodiments address the above and/or other issues by providing a finisher for an imaging device that may easily and rapidly perform a finishing operation on a medium such as a sheet.

In particular, the finisher may finish a sheet along a path on which the sheet travels in an imaging device. The sheet may travel to and between a pair of rotatable upstream rollers and a pair of rotatable downstream rollers. When a trailing edge of the sheet is about to leave the nip of the upstream rollers, the downstream rollers can be stopped, causing the sheet to buckle, such that a trailing edge of the sheet registers against the upstream nip line. The sheet may then be hole punched, stapled, or subject to any other finishing operation. This finishing operation can be performed at a speed equal to or greater than a speed at which the image forming apparatus forms the image on the medium and outputs the medium to the finisher.

In an exemplary embodiment, a finisher performs a finishing operation for an image forming apparatus, the image forming apparatus defining a path along which a medium, on which an image is formed, travels. The medium includes a leading edge and a trailing edge. The finisher includes a pair of rotatable upstream rollers and a pair of rotatable downstream rollers. The upstream rollers aid the downstream rollers assist in moving the medium along the path. The upstream rollers may he positioned upstream of the downstream rollers relative to the path. Furthermore, the pair of upstream rollers and the pair of downstream rollers may respectively define an upstream nip and a down stream nip. Although this embodiment includes two pairs of rollers in which to move the medium along the path, it is envisioned that any number of structures and/or devices that can move and/or stop a medium along a path in an image forming device may be implemented without departing from the scope of the exemplary embodiments.

The finisher further includes a determining device to determine when the trailing edge of the medium is about to leave the nip of the upstream rollers, and a stopping device that stops the leading edge of the medium when the determining device determines that the trailing edge of the medium is about to leave the nip of the upstream rollers.

In an exemplary embodiment, the determining device may be a reflective optical sensor mounted in a fixed position upstream of the upstream nip. The upstream nip may be driven by a stepper motor or a servo motor. The downstream nip may be driven by a separate stepper motor or servo motor. The position and displacement of the medium may then be controlled by a single controller, which is appropriately connected to the determining device and both upstream and downstream motors. The single controller may be currently known or may be a controller developed in the future. Information obtained by the controller may be used to stop the downstream nip by ramping the stepper motor pulse rate to zero, in the case of the stepper motor, or stalling the servo motor by appropriate electrical means. After an appropriate period, the trailing edge of the medium may clear the upstream nip and the finishing operation may be implemented. Upon completion of the finishing operation, the downstream nip may deliver the medium.

In particular, in an exemplary embodiment, when the downstream roller stops the leading edge of the medium, the upstream roller continues to move the medium forward, causing the medium to buckle between the downstream roller and the upstream roller. This buckling of the medium causes the trailing edge of the medium to register against the upstream nip line. A finishing device can perform a finishing operation to the medium when the trailing edge registers against the upstream nip line.

In an exemplary embodiment, the downstream rollers may stop the leading edge. However, any device that can stop the medium so that the trailing edge of the medium registers against the upstream rollers may be used. Similarly, in the exemplary embodiment, the upstream rollers continue to move the medium forward after the downstream rollers stop the leading edge of the medium. However any device that can continue to move the medium along the path when the leading edge is stopped, and that may allow the trailing edge to register to position the medium for finishing, may be used.

The finishing device may include a hole puncher, stapler, binder, or any like device to perform any desired finishing operation on the medium after an image has been formed thereon.

DETAILED DESCRIPTION OF EMBODIMENT

With reference to the Figures, the exemplary embodiments are directed to a finisher for an imaging device that may easily and rapidly finish a medium such as a sheet.

Figure 1:
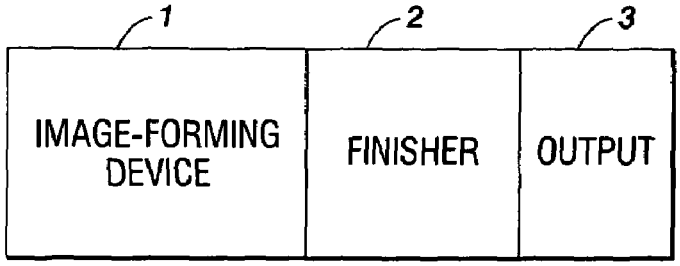
FIG. 1 is a schematic of a system including series of modules in an exemplary embodiment.

In the exemplary embodiment of FIG. 1, for example, a system including a series of modules is illustrated. In the first module, an image-forming device 1 forms an image on a medium, such as, for example, a sheet. Various processes for forming an image on a sheet are well known, and the specific details of such process will not be discussed in detail herein. After the image is formed on the sheet, the sheet is transported to a finisher 2, or optionally directly to an output module 3. At the finisher 2 (which may be integrally formed with the image forming device 1 or which may be a separate device connected to the image forming device 1), the sheet may have a number of different finishing operations formed thereon. For example, the sheet may be punched with a hole, stapled to a plurality of other sheets, cut, bound, etcetera. Finally, the finished sheet may be output by the output module 3.

Figure 2:
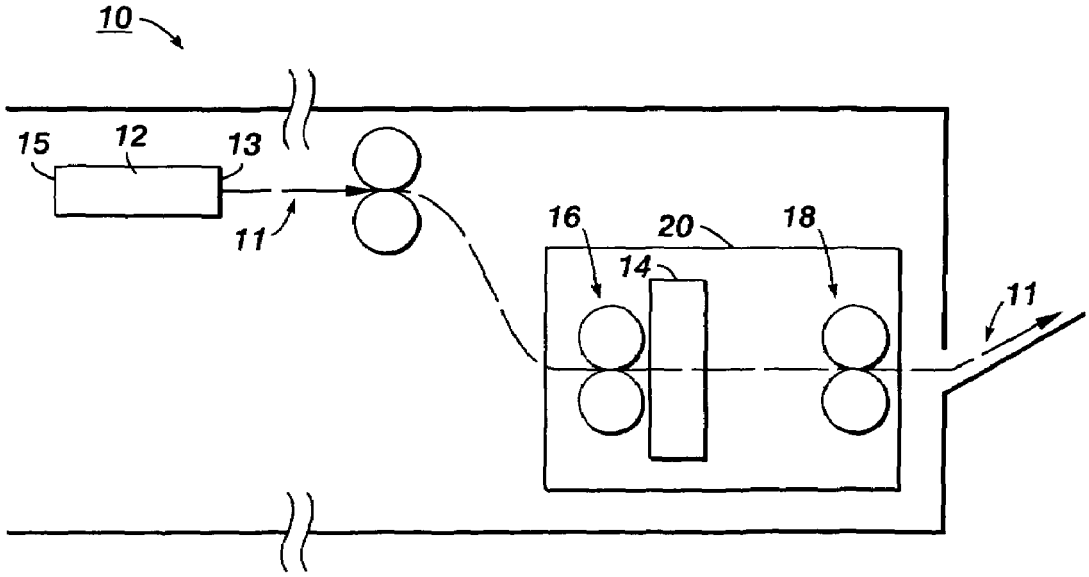
FIG. 2 is a schematic of a finisher integrally formed with an imaging device in an exemplary embodiment.

In an exemplary embodiment of FIG. 2, a finisher 20 for an image forming apparatus 10, such as a copier or a printer, is illustrated. The image forming apparatus 10 forms an image on a medium, such as, for example, a sheet 12. The sheet 12 is then conveyed to the finisher 20. The finisher 20 has a mechanism to perform a finishing operation to the sheet; for example, in the exemplary embodiment of FIG. 2, the finisher 20 includes a punching unit 14 for punching at least one hole in the sheet 12. However, the exemplary embodiment is not limited to that operation, and is intended to cover any mechanism to perform any operation on the sheet, or the operation relating to other sheets. For example, the mechanism can be a stapling unit to staple a plurality of sheets together. The finisher 20 of the embodiment of FIG. 2 is integral with the image forming apparatus 10. However, the finisher 20 may be separate and distinct from the image forming apparatus 10.

To properly and accurately punch holes in the sheet 12, or correctly staple the sheet 12 or a plurality of sheets, the sheet and/or the punching unit 14 must be respectively aligned to punch holes in the sheet 12 in a desired location. To this end, the punching unit 14 may be aligned between a pair of upstream rollers 16 and a pair of downstream rollers 18.

Figure 3:
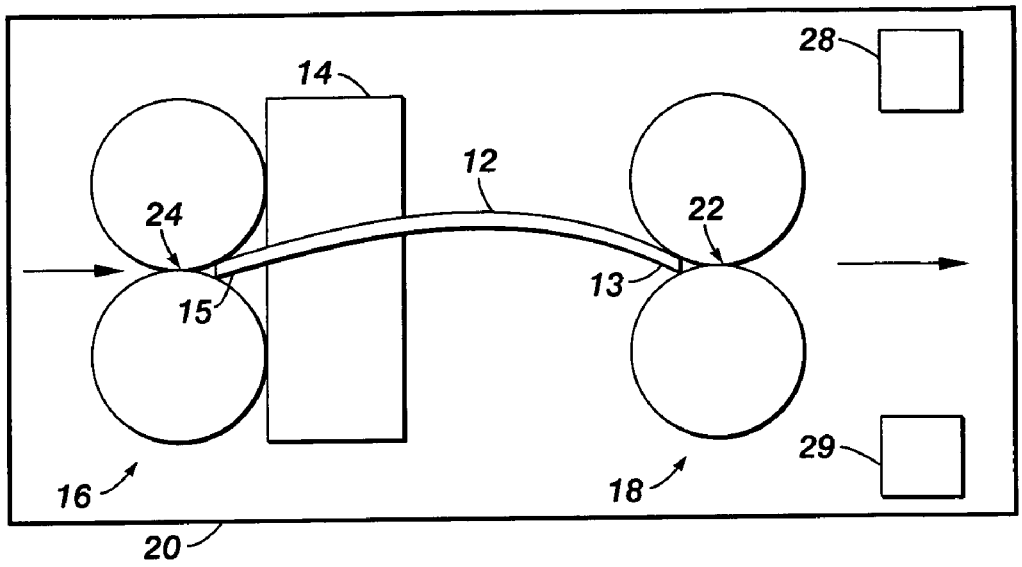
FIG. 3 is a schematic of the finisher of FIG. 1.

More specifically, as shown in FIG. 3, the image forming apparatus 10 defines a path 11 along which a medium 12, on which an image is formed, travels. The medium 12 may be a sheet, for example, or any other medium in which an image may be formed. The path 11 may be a conveyor belt, for example, or any substrate that can convey the medium 12. The medium 12 includes a leading edge 13 and a trailing edge 15.

Figure 4:
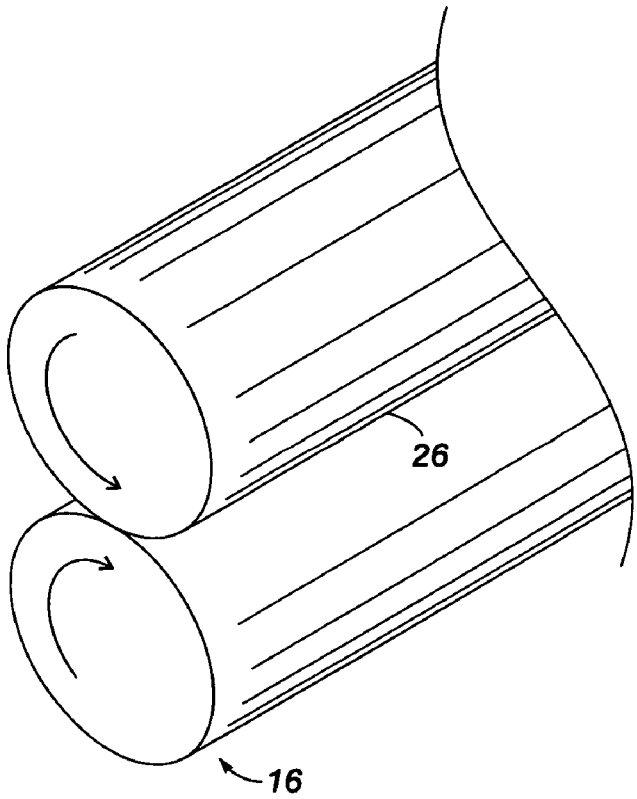
FIG. 4 is a schematic of upstream rollers in an exemplary embodiment.
Figure 5:
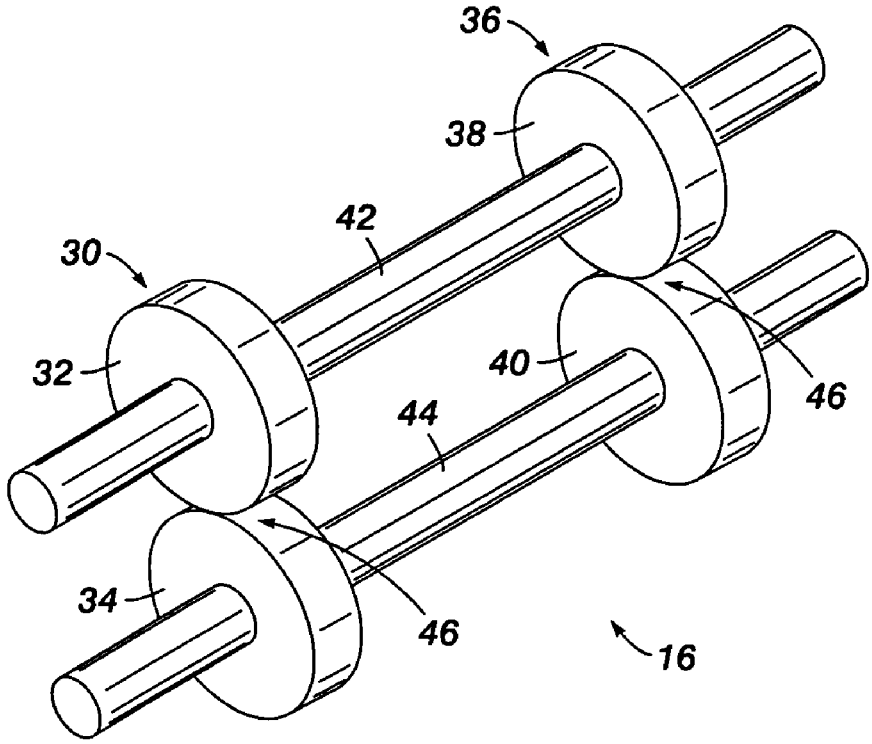
FIG. 5 is a schematic of upstream rollers in an exemplary embodiment.

The finisher 20 may include a pair of rotatable downstream rollers 18 and a pair of rotatable upstream rollers 16. The downstream rollers 18 and the upstream rollers 16 respectively define a downstream nip 22 and an upstream nip 24. The upstream rollers 16 are upstream of the downstream rollers 18 relative to the path As shown in FIG. 4, the upstream nip 24 may form an upstream solid nip line 26. (The downstream nip 22 may also form a downstream solid nip line, which is not shown in FIG. 4). In another embodiment, as shown in FIGS. 5, a series of rollers may form the upstream rollers 16, or the downstream rollers 18. For example, a first set of rollers 30 defined by a first top roller 32 and a first bottom roller 34, and a second set of rollers 36 defined by a second top roller 38 and a second bottom roller 40, may be respectively connected by a first shaft 42 and a second shaft 44. More specifically, the first shaft 42 may connect the first top roller 32 and the second top roller 38, and the second shaft 44 may connect the first bottom roller 34 and the second bottom roller 38. A nip defined by the first set of rollers 30 and a nip defined by the second set of rollers 36, may collectively define a nip line 46.

With reference again to FIG. 3, the finisher 20 may also include a device 28 to determine when the trailing edge 15 of the medium 12 is about to leave the nip 24 of the upstream rollers 16. The device 28 may be, for example a controller associated with the image forming apparatus 10, a timer, a sensor to detect the position of the medium 12, or any device that may determine when the trailing edge 15 of the medium 12 is about to leave the nip 24. The finisher 20 may also include a stopping device 29 that stops the leading edge 13 of the medium 12 when the device 28 determines that the trailing edge 15 of the medium 12 is about to leave the nip 24 of the upstream rollers 16, such that the trailing edge 15 registers against the upstream nip 24. In an exemplary embodiment, the stopping device 29 stops the leading edge 13 of the medium 12 by stopping rotation of the downstream rollers 18.

The device 28 and the stopping device 29 may be separate components or may be the same component. For example, the device 28 and the stopping device 29 may be constituted by a single controller.

By stopping the leading edge 13 of the medium 12, the medium 12 is forced to buckle such that the trailing edge 15 of the medium 12 registers against the upstream solid nip line 26 of the upstream rollers 16 (shown in FIG. 4), or alternatively by the nip line 46 (shown in FIG. 5). The registration of the trailing edge 15 of the medium 12 against, for example, the upstream solid nip line 26 places the medium in position so that a finishing operation may be performed thereon. The finishing device 20 then performs a finishing operation.

Figure 6:
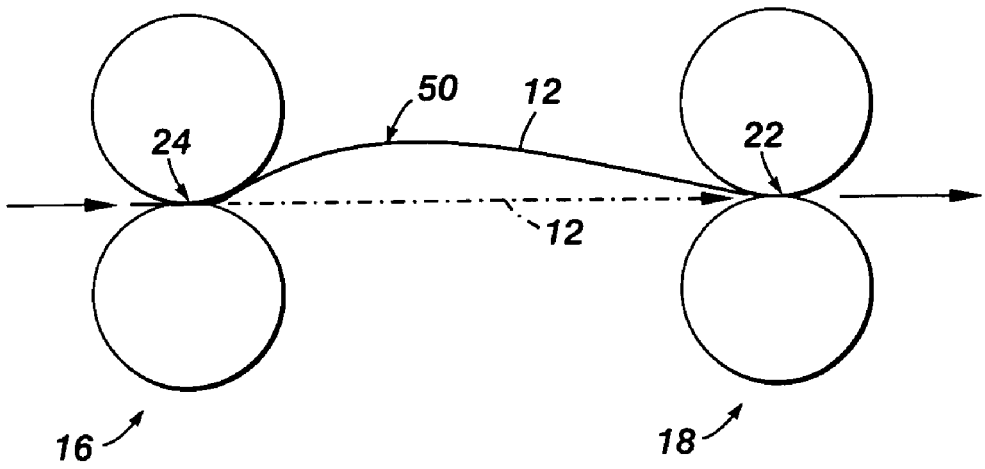
FIG. 6 is a schematic of a medium between two nips in an exemplary embodiment.

More specifically, shown in FIG. 6, as the medium 12 is fed from the upstream nip 24 or 46, to the downstream nip 22, the medium follows a first trajectory L1. When the medium displacement from the upstream nip 24, 46 exceeds the downstream nip 22, a buckle 50 forms. A buckling capacity is reached when the trajectory approaches the constraints of the medium path as showing in second trajectory L2. A difference in length between the first trajectory L1 and the second trajectory L2 is the buckling capacity.

Figure 8:
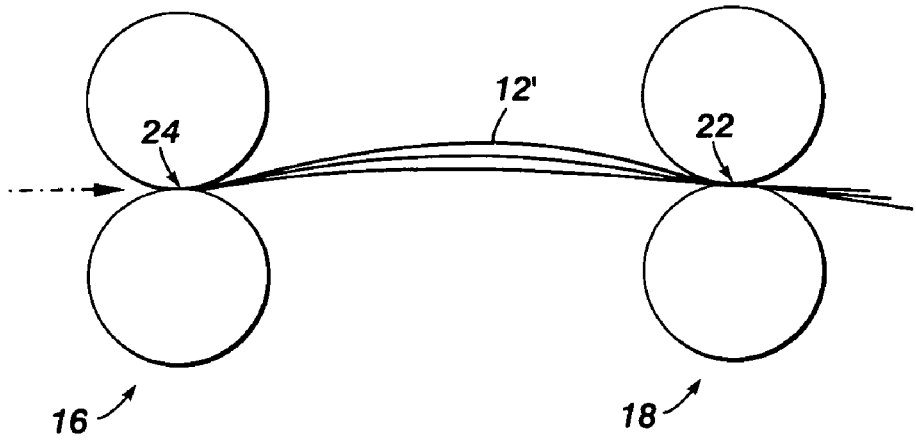
FIG. 8 is a schematic of a plurality of overlapping mediums between two nips in an exemplary embodiment.
Figure 9:
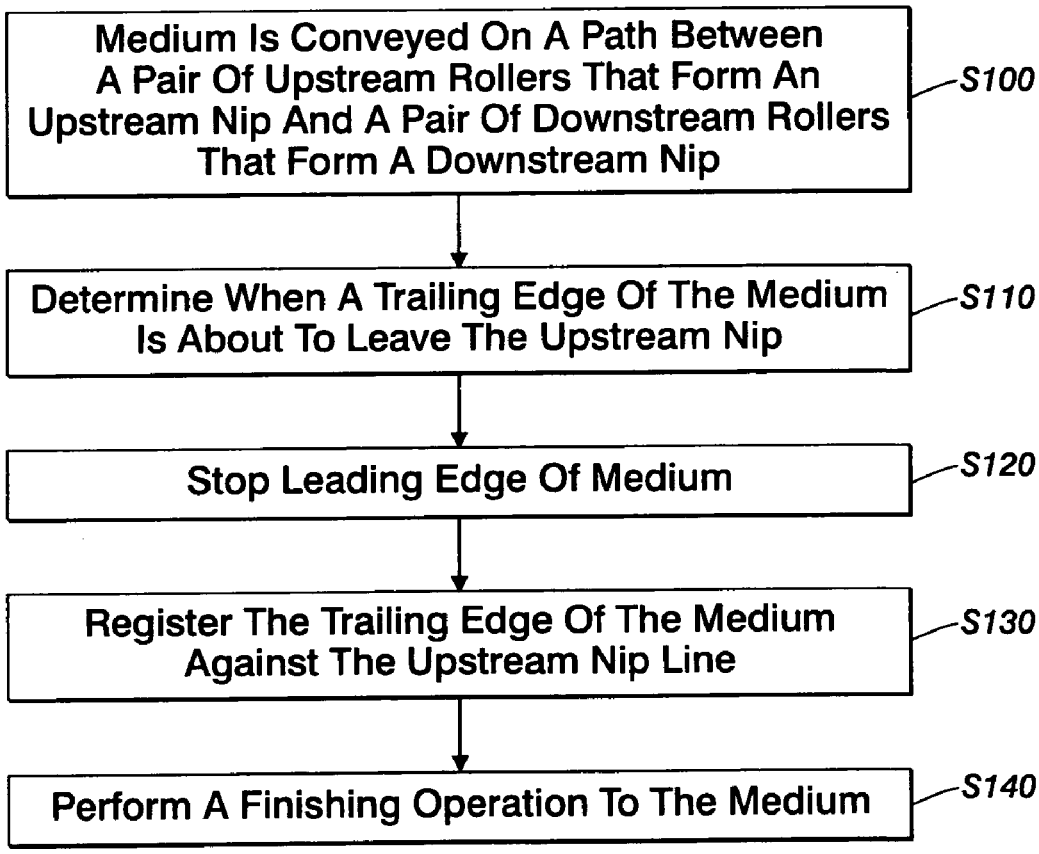
FIG. 9 is a schematic flowchart of a method for finishing a medium in an image forming apparatus in an exemplary embodiment.

In this way, the medium may be placed in position for finishing without the need for additional sensors and timing devices, and without the need for movement, placement, and/or realignment of the finishing device.

another exemplary embodiment, a plurality of mediums may enter the finishing module for the same operation. For example, with reference to FIG. 8, a number of mediums may be introduced to the finisher for a finishing operation, such as, for example, stapling. Stapling a set of mediums requires each medium to be fed into the upstream and downstream nips in an overlapped fashion. The maximum overlap must be within a buckling capacity of a trajectory path between the upstream and downstream nip. For example, two or three sheets may be fed into the upstream nip with their respective trailing edges somewhat misaligned relative to each other, and also relative to the finishing device. The two or three misaligned sheets may also be fed to the down stream nip. Each of these sheets may be registered at the nip line. The bottom most sheet may not have the longest length of paper between the upstream and downstream nip as this would drive the upper sheets away from the registration nip.

With reference to FIG. 6, the buckling capacity of the trajectory path between the upstream nip and the downstream nip is further explained by example. For example, with a buckle chamber with about a 9 mm capacity, and three sheets with about 3 mm of trailing edge misalignment, the incoming medium (i.e., three sheets) could be overlapped such that there is about a 3 mm nominal offset between the trailing edges of the sheets and the topmost sheet trailed. With such a configuration the topmost trail edge, or third sheet, may achieve about 9 mm of buckle, a middle sheet may achieve about 6 mm of buckle, and the first sheet may achieve about 3 mm of buckle.

Figure 7:
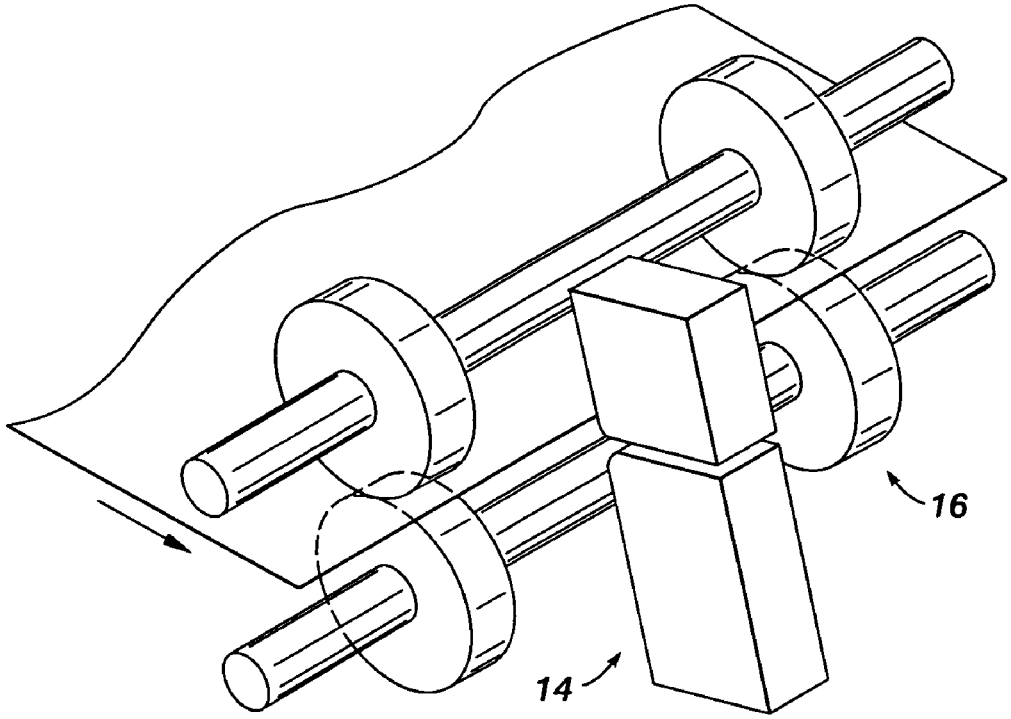
FIG. 7 is a schematic of the finisher in an exemplary embodiment.

In an exemplary embodiment, the finishing 20 may be in close proximity to the trailing edge of the medium. For example, as shown in FIG. 4, the upstream solid nip line 26 is a solid nip. A solid nip of relatively small diameter upstream rolls 16 would allow, for example, an edge of punch dies of, for example, the punching unit 14, to clear a shaft of the upstream rollers 16. Alternatively, in another exemplary embodiment, as shown in FIGS. 6 and 7, relatively larger diameter upstream rolls 16 could be implemented, with for example, larger roll segments of about 20 mm to 25 mm on a 6 mm to 8 mm shaft.

Furthermore, with respect to a finishing operation including stapling, stapling small sets of medium requires the imaged medium to be fed into the upstream rollers 16 and downstream nips in an overlapped fashion. The maximum overlap must be within the buckling capacity of paper path between the upstream and downstream nip.

The finishing operation may include punching a hole or a plurality of holes in the medium 12. Alternatively, the finishing operation may include stapling the medium 12 to at least one other medium that has been processed by the image forming apparatus 10. The finisher 20 may perform any number of finishing type operations to the medium 12 and is not limited to the specific embodiments discussed herein. For example, the finishing operation may also include binding, and the like.

In an exemplary embodiment, the finisher 20 performs the finishing operation to the medium 12 at a speed equal to or greater than a speed at which the image forming apparatus forms the image on the medium and outputs the medium to the finisher 20. For example, the finisher 20 performs the finishing operation to the medium 20 at a speed greater than 144 pages per minute, and more specifically at a speed of about 180 pages per minute.

With reference to FIG. 5, a method for finishing a medium in an image forming apparatus is illustrated. As discussed above, the image forming apparatus defines a path along which a medium, on which an image is formed, travels.

After the image forming apparatus forms an image on the medium, the medium is conveyed along the path between a pair of rotatable downstream rollers and a pair of rotatable upstream rollers, as shown at step S100. As discussed above, the upstream rollers define an upstream nip line. A determination as to when a trailing edge of the medium is about to leave the nip of the upstream rollers may be made, as shown at step S110. The leading edge of the medium may be stopped when it is determined that the trailing edge of the medium is about to leave the nip of the upstream rollers, as shown at step S120. When the medium is stopped, as shown at step S120, the medium may buckle such that the trailing edge of the medium registers against the upstream nip line, as shown at step S130. When the trailing edge of the medium registers against the upstream nip line, the medium can be properly positioned for a finishing operation. As shown at step S140, a finishing operation may be performed to the medium when the trailing edge registers against the upstream nip.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A finisher for an image forming apparatus, the image forming apparatus defining a path along which a medium, on which an image is formed, travels, the medium including a leading edge and a trailing edge, the finisher comprising:

a pair of rotatable downstream rollers;

a pair of rotatable upstream rollers defining a nip having an upstream nip line, the upstream rollers being upstream of the downstream rollers relative to the path;

a determining device to determine when the trailing edge of the medium is about to leave the nip of the upstream rollers;

a stopping device that stops the leading edge of the medium when the determining device determines that the trailing edge of the medium is about to leave the nip of the upstream rollers, such that the trailing edge registers against the upstream nip line before the trailing edge of the medium leaves the nip of the upstream rollers; and a finishing device that performs a finishing operation to the medium when the trailing edge registers against the upstream nip line.

2. The finishing device of claim 1, wherein the finishing device performs the finishing operation to the medium at a speed equal to or greater than a speed at which the image forming apparatus forms the image on the medium and outputs the medium to the finisher.

3. The finishing device of claim 2, wherein the finishing device performs the finishing operation to the medium at a speed greater than 145 pages per minute.

4. The finishing device of claim 2, wherein the finishing device performs the finishing operation to the medium at a speed of about 180 pages per minute.

5. The finisher of claim 1, wherein the determining device and the stopping device are constituted by a single controller.

6. The finisher of claim 1, wherein the determining device is a timer or a sensor that detects a position of the medium.

7. The finisher of claim 1, wherein the stopping device stops the leading edge of the medium by stopping rotation of the downstream rollers.

8. The finisher of claim 1, wherein the stopping device stops the leading edge of the medium such that the medium buckles so that the trailing edge registers against the upstream nip line.

9. The finisher of claim 1, wherein the finishing device is a hole puncher or a stapler.

10. A method for finishing a medium in an image forming apparatus, the image forming apparatus defining a path along which a medium, on which an image is formed, travels, the medium including a leading edge and a trailing edge, the method comprising:

conveying the medium along the path between a pair of rotatable downstream rollers and a pair of rotatable upstream rollers defining a nip having an upstream nip line, the pair of rotatable upstream rollers being upstream the pair of downstream rollers relative to the path;

determining when the trailing edge of the medium is about to leave the nip of the upstream rollers;

stopping the leading edge of the medium when the determining device determines that the trailing edge of the medium is about to leave the nip of the upstream rollers, such that the trailing edge registers against the upstream nip line before the trailing edge of the medium leaves the nip of the upstream rollers; and performing a finishing operation to the medium when the trailing edge registers against the upstream nip.

11. The method of claim 10, further comprising:

performing the finishing operation to the medium at a speed equal to or greater than a speed at which the image forming apparatus forms the image on the medium and outputs the medium to the finisher.

12. The method of claim 11, further comprising:

performing the finishing operation to the medium at a speed greater than 145 pages per minute.

13. The method of claim 11, further comprising:

performing the finishing operation to the medium at a speed of about 180 pages per minute.

14. The method of claim 10, wherein a single controller determines when the trailing edge of the medium is about to leave the nip of the upstream rollers and the stops the rotation of the downstream rollers.

15. The method of claim 10, wherein a timer or a sensor that detects the position of the medium determines when the trailing edge of the medium is about to leave the nip of the upstream rollers.

16. The method of claim 10, wherein rotation of the downstream rollers is stopped to stop the leading edge of the medium, such that the trailing edge registers against the upstream nip line.

17. The method of claim 16, wherein when the leading edge is stopped, the medium buckles so that the trailing edge registers against the upstream nip line.

18. The method of claim 10, wherein the finishing operation performed to the medium when the trailing edge registers against the upstream nip includes a hole punch.

19. The method of claim 10, wherein the finishing operation performed to the medium when the trailing edge registers against the upstream nip includes stapling the medium to at least one other medium.

20. A system for finishing an image in an image forming apparatus, the image forming apparatus defining a path along which a medium, on which an image is formed, travels, the medium including a leading edge and a trailing edge, the system comprising:

means for conveying the medium along the path between a pair of rotatable downstream rollers and a pair of rotatable upstream rollers defining a nip having an upstream nip line, the pair of rotatable upstream rollers being upstream the pair of downstream rollers relative to the path;

means for determining when the trailing edge of the medium is about to leave the nip of the upstream rollers;

means for stopping the leading edge of the medium when the determining device determines that the trailing edge of the medium is about to leave the nip of the upstream rollers, such that the trailing edge registers against the upstream nip line before the trailing edge of the medium leaves the nip of the upstream rollers; and means for performing a finishing operation to the medium when the trailing edge registers against the upstream nip.

* * * * *